US007240771B2

(12) United States Patent
Perkins

(10) Patent No.: US 7,240,771 B2
(45) Date of Patent: Jul. 10, 2007

(54) MAST STAGING HYDRAULIC CIRCUIT

(75) Inventor: Gerard T. Perkins, Hopkinsville, KY (US)

(73) Assignee: The Raymond Corporation, Greene, NY (US)

( * ) Notice: Subject to any disclaimer, the term of this patent is extended or adjusted under 35 U.S.C. 154(b) by 140 days.

(21) Appl. No.: 11/100,654

(22) Filed: Apr. 7, 2005

(65) Prior Publication Data

US 2005/0263354 A1 Dec. 1, 2005

Related U.S. Application Data

(60) Provisional application No. 60/574,192, filed on May 25, 2004.

(51) Int. Cl.
*B66B 9/06* (2006.01)

(52) U.S. Cl. ..... 187/229; 187/226; 187/234; 187/274; 187/275; 187/346; 254/423; 254/89 H; 254/93 R; 91/525; 91/533; 60/422; 60/484

(58) Field of Classification Search ..... 187/222–238, 187/274, 275, 346; 254/423, 89 H, 93 R; 60/470, 472, 477, 480, 494, 547.2, 422, 484; 91/399, 405, 519, 525, 526, 527, 533; 212/347–350
See application file for complete search history.

(56) References Cited

U.S. PATENT DOCUMENTS 3,077,951 A * 2/1963 Ramsey ..... 187/229
4,467,894 A 8/1984 Sinclair
4,593,791 A 6/1986 Matthews
4,655,031 A * 4/1987 Kucera ..... 56/11.9
4,763,800 A 8/1988 Engler et al.
4,896,748 A 1/1990 Mikkelsen et al.
5,022,496 A 6/1991 Klopfleisch et al.
5,110,251 A * 5/1992 Gray ..... 414/545
5,657,834 A 8/1997 Plaugher et al.
5,816,366 A 10/1998 Briday et al.
5,927,520 A 7/1999 Barthalow et al.
6,367,365 B1 * 4/2002 Weickert et al. ..... 91/447

FOREIGN PATENT DOCUMENTS

EP 0 886 026 9/1998

OTHER PUBLICATIONS

PCT International Search Report dated Sep. 6, 2005.

* cited by examiner

*Primary Examiner*—Gene O. Crawford
*Assistant Examiner*—Stefan Kruer
(74) *Attorney, Agent, or Firm*—Quarles & Brady LLP

(57) ABSTRACT

A multistage mast assembly for use on a lift truck and method of operation for staging first and second mast sections of the multistage mast assembly. Each mast section has a retracted position and an extended position. The apparatus includes a mast staging hydraulic circuit which diverts hydraulic fluid from the second mast section actuator to the first mast section actuator using a multi-position valve having an open position and a restricted flow position. In the restricted flow position, hydraulic pressure in a hydraulic line supplying the second mast section increases to divert hydraulic fluid to the first mast section actuator before the second mast section reaches its extended position.

10 Claims, 2 Drawing Sheets

MAST STAGING HYDRAULIC CIRCUIT

CROSS REFERENCES TO RELATED APPLICATIONS

This application claims the priority benefit of U.S. Provisional Patent Application No. 60/574,192 filed on May 25, 2004.

STATEMENT REGARDING FEDERALLY SPONSORED RESEARCH

Not Applicable

BACKGROUND OF THE INVENTION

The present invention relates to mast staging of a multistage mast assembly, in particular to method and apparatus which reduces shock loads encountered in the transition between stages of a multistage mast assembly of a lift truck Known lift trucks, such as Reach-Fork® and Swing-Reach® trucks available from The Raymond Corporation in Greene, N.Y., include a vertically extendible mast supporting a carriage which incorporates "mast staging" to lift a carriage to considerable heights. "Mast staging" refers to a method of lifting/lowering loads on a lift truck carriage in stages (sections). To lift, a fixed hydraulic ram extends until it reaches its end of stroke, whereupon, successive rams (stages) continue the lift. Unfortunately, a shock load is generated as one ram decelerates rapidly at its end of stroke and the next ram accelerates upward. These shock loads reduce the life of the mast components, and can propagate through the lift truck to the discomfort of the operator, and can destabilize on the carriage.

One known method of mast staging intended to reduce shock loads is disclosed in U.S. Pat. No. 5,022,496. The disclosed method continuously monitors the carriage position relative to the mast, and slows the rate of movement of the carriage immediately before and during a stage transition. Once the transition is complete, the carriage speed is increased to the operator selected speed. This method changes the speed of the carriage as it moves in a vertical direction which can destabilize a load on the carriage, and cause discomfort to an operator.

Another known method of mast staging intended to reduce shock loads is disclosed in U.S. Pat. No. 5,657,834. The disclosed method incorporates spring elements at the end of each mast stage to cushion the transition between stages. This particular method increases the complexity of the mast assembly and the difficulty of retrofitting an existing mast assembly. Therefore a need exists for a mast staging method and apparatus which can be easily incorporated into a lift truck, and does not require changing the vertical speed of a carriage during the transition between stages.

SUMMARY OF THE INVENTION

The present invention provides a multistage mast assembly for use on a lift truck. The mast assembly includes a first mast section mountable to the truck and a second mast section. The first and second mast sections are extendible between retracted positions and extended positions, wherein extending at least one of the first mast section and the second mast section raises the carriage.

In one embodiment, the mast assembly includes a first hydraulic actuator having an extendible ram fixed to the first mast section, wherein actuation of the first hydraulic actuator extends the ram to urge the first mast section to the extended position. A second hydraulic actuator is fixed relative to the first mast section, and has an extendible ram fixed relative to the second mast section, wherein actuation of the second hydraulic actuator extends the second hydraulic actuator ram to urge the second mast section to the second mast section extended position. The first and second hydraulic actuators receive hydraulic fluid from a hydraulic supply line. A first hydraulic line supplies hydraulic fluid from the hydraulic supply line to the first hydraulic actuator, and a second hydraulic line in parallel with the first hydraulic line supplies hydraulic fluid from the hydraulic supply line to the second hydraulic actuator.

A multi-position valve controlling hydraulic fluid flowing through the first hydraulic line has an open position and a restricted flow position, wherein hydraulic fluid flows from the supply line through the first hydraulic line to the second hydraulic actuator to extend the second mast section from the second mast section retracted position toward the second mast section extended position when the valve is in the open position. Hydraulic fluid pressure in the first hydraulic line increases to divert hydraulic fluid from the hydraulic supply line into the second hydraulic line to actuate the first hydraulic actuator and begin extending the first mast section toward the first mast section extended position prior to the second mast section reaching the second mast section extended position when the valve is shifted to the restricted flow position before the second mast section reaches the second mast section extended position.

In another embodiment, the second mast section includes a carriage, and when the valve is in the restricted flow position, the first mast section begins extending toward the first mast section extended position prior to the second mast section reaching the second mast section extended position without changing the vertical speed of the carriage.

A general objective of the present invention is to provide a multistage mast assembly which transitions between stages without changing the vertical speed of the carriage. This objective is accomplished by decelerating the initial stage at a rate which equals the acceleration rate of the next stage during staging to maintain the carriage at a constant vertical speed.

Another objective of the present invention is to provide a lift truck having a multistage extendible mast which does not produce shock loads when transitioning between stages. This objective is accomplished by providing a hydraulic circuit which modulates flow and pressure between two stages to provide a controlled deceleration of the initial stage and a controlled acceleration of the next stage to provide a smooth momentum transition between stages without changing the speed of the carriage.

This and still other objects and advantages of the present invention will be apparent from the description which follows. In the detailed description below, preferred embodiments of the invention will be described in reference to the accompanying drawings. These embodiments do not represent the full scope of the invention. Rather the invention may be employed in other embodiments. Reference should therefore be made to the claims herein for interpreting the breadth of the invention.

DETAILED DESCRIPTION OF THE INVENTION

Figure 1:
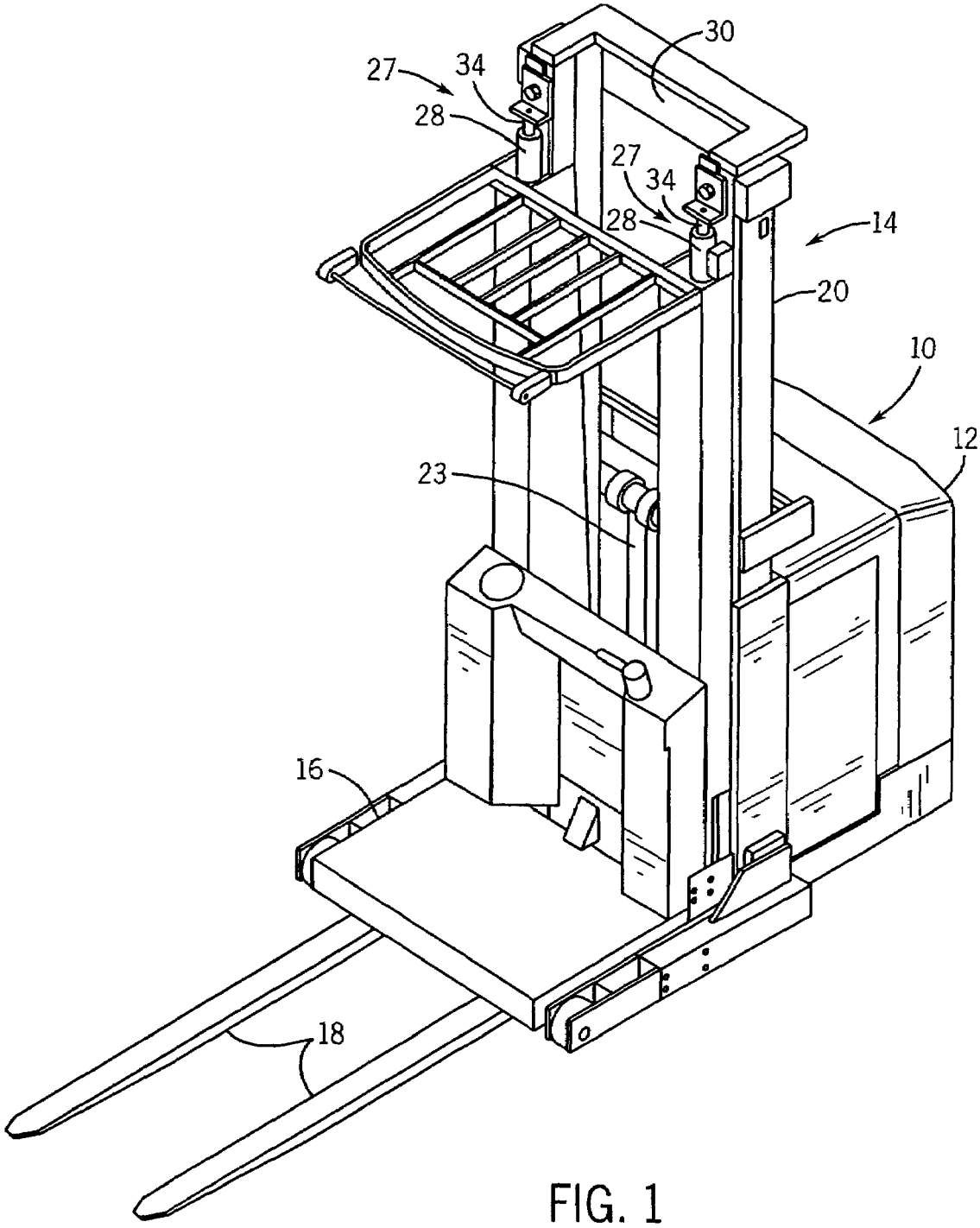
FIG. 1 is a lift truck incorporating the present invention.
Figure 2:
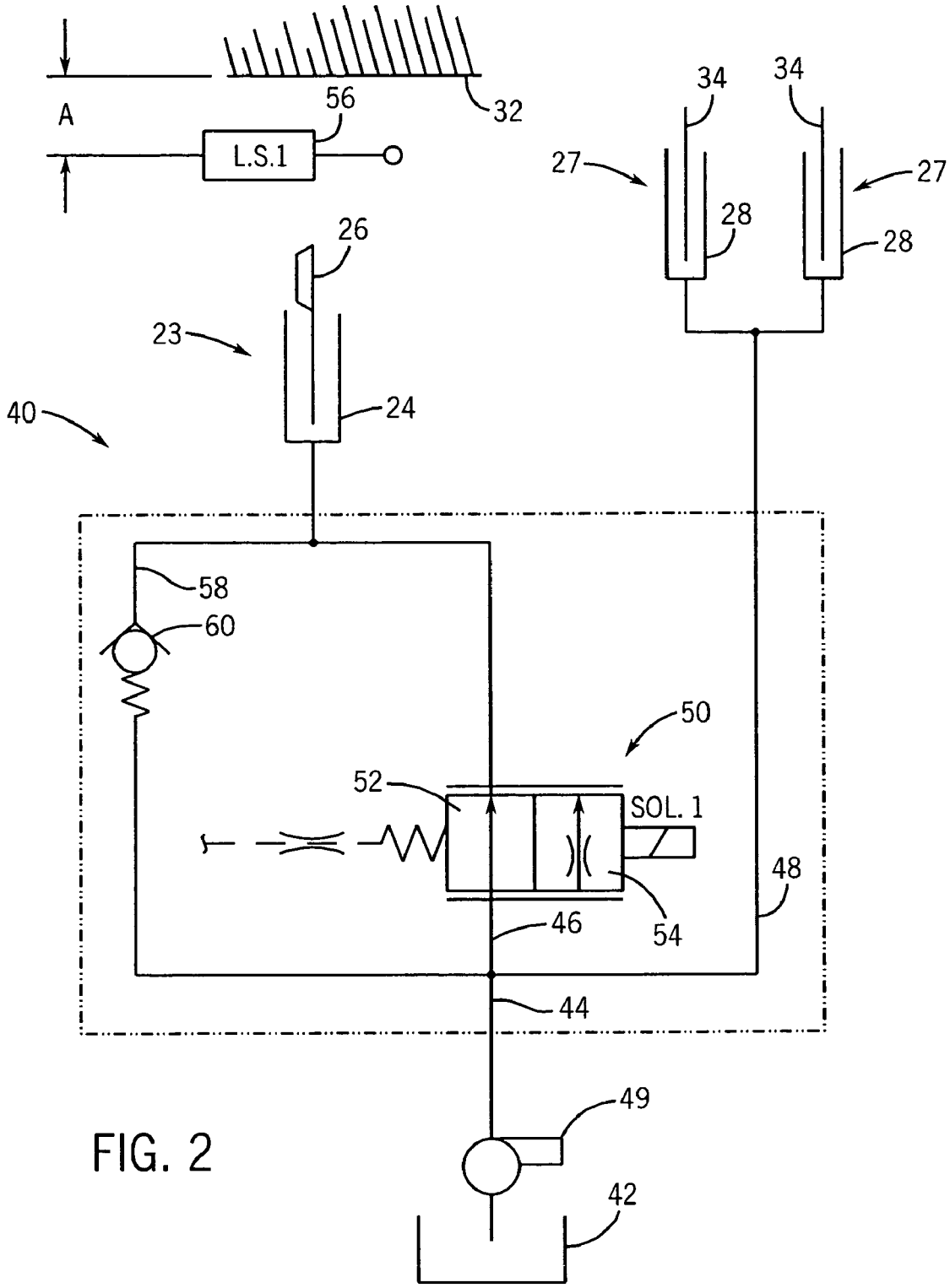
FIG. 2 is a detailed mast assembly schematic showing the mast staging hydraulic circuit of the lift truck of FIG. 1.

As shown in FIGS. 1 and 2, a lift truck 10 includes a motorized tractor 12 and an extendible multistage mast assembly 14 mounted thereon. The mast assembly 14 includes a fixed, vertically extending outer telescopic 20 and an inner telescopic 30 slidably mounted to the outer telescopic 20 for vertical movement between an extended position and a retracted position. A carriage 16 is slidably mounted to the inner telescopic 30 for vertical movement between an upper position and a lower position. A pair of forks 18 extend from the carriage 16 to vertically support a pallet (not shown). The lift truck 10 can be any commercially available lift truck having a multistage mast assembly, such as a Raymond Easi™ Orderpicker available from Raymond Corporation, Greene, N.Y.

In the embodiment disclosed herein, the mast assembly 14 includes a first stage and a second stage, as described below. However, the mast assembly 14 can include any number of stages without departing from the scope of the invention. The first mast stage of the multistage mast assembly 14 includes the carriage 16 which is lifted from the lower position to the upper position by a free lift hydraulic cylinder assembly 23. The free lift cylinder assembly 23 includes a free lift cylinder 24 fixed to the inner telescopic 30 and an extendible ram 26 fixed to the carriage 16. Actuation of the free lift cylinder assembly 23 extends the ram from a retracted position to an extended position to lift the carriage 16. A fixed stop 32 prevents the ram 26 from extending past the upper position. The bore size of the cylinder 24 is dependent upon the operating requirements of the lift truck 10. In the embodiment disclosed herein, the free lift cylinder bore has a 2.5 inch diameter.

The second mast stage of the mast assembly 14 includes the inner telescopic 30 and a pair of inner telescopic hydraulic cylinder assemblies 27. The inner telescopic hydraulic cylinder assemblies 27 are in fluid communication with the free lift cylinder 24, and lift the inner telescopic 30, and thus the carriage 16, when the carriage 16 approaches the upper position and the stop 32. Advantageously, a hydraulic circuit 40 diverts hydraulic fluid from the free lift cylinder 24 to the pair of inner telescopic hydraulic cylinder assemblies 27 to provide a smooth transition between the stages.

Each inner telescopic hydraulic cylinder assembly 27 includes a inner hydraulic cylinder 28 and an inner telescopic ram 34. The inner hydraulic cylinder 28 is fixed relative to the outer telescopic 20, and the inner telescopic ram 34 is fixed to the inner telescopic 30. As in the free lift cylinder 24, the bore size of the inner telescopic cylinders 28 is dependent upon the operating requirements of the lift truck 10. In the embodiment disclosed herein, each inner telescopic cylinder 28 has a 1.75 inch diameter bore.

The relative size of the cylinder bores ensures the proper sequential operation of the hydraulic cylinder assemblies 23, 27. In particular, the free lift cylinder 24 has a larger cylinder bore than the inner telescopic cylinders 28 to ensure that the free lift cylinder 24 has a lower hydraulic fluid pressure requirement to actuate the free lift ram 26 than the hydraulic fluid pressure requirement of the inner telescopic cylinder 28. By providing the free lift cylinder 24 with a lower hydraulic fluid pressure requirement than the inner telescopic cylinders 28, the free lift cylinder assembly 23 will begin lifting the carriage 16 prior to actuation of the inner telescopic cylinder assemblies 27.

Referring to FIG. 2, pressurized hydraulic fluid is supplied to the cylinders 24, 28 by the hydraulic circuit 40 which includes a reservoir 42 for holding the hydraulic fluid. The hydraulic fluid is pumped through a supply line 44 to a pair of parallel branch lines 46, 48, using methods known in the art, such as a pump 49. Each branch line 46, 48 supplies pressurized hydraulic fluid to actuate the cylinders 24, 28 and extend the respective rams 26, 34 to raise the carriage 16.

A solenoid-actuated two position valve 50 in the first stage hydraulic branch line 46 supplying fluid to the free lift cylinder 24 has an open flow position 52 and a restricted flow position 54. When the free lift ram 26 reaches a predetermined distance A from its extended position, a signaling device 56, such as a limit switch, encoder, and the like, signals the hydraulic system control to shift the valve 50 to the restricted flow position 54 and divert a portion of the hydraulic fluid through the second stage hydraulic branch line 48 to the inner telescopic cylinders 28. Advantageously, in the disclosed embodiment, diverting the hydraulic fluid from the free lift cylinder 24 toward the inner telescopic cylinders 28 reduces the rate of extension of the free lift ram 26 while initiating the extension of the inner telescopic rams 34 without significantly changing the net speed of movement of the carriage 16. Preferably, the pump 49 and valve 50 are controlled by a hydraulic circuit control (not shown) known in the art, such as a microprocessor.

A first stage return line 58 returns hydraulic fluid from the free lift cylinder 24 to the supply line 44. The hydraulic fluid is returned to the supply line 44 when the free lift ram 26 is fully extended and cannot accept additional hydraulic fluid, and when the free lift ram 26 is returning to the retracted position. A check valve 60 disposed in the return line 58 prevents hydraulic fluid from bypassing the two position valve 50 and flowing directly to the free lift cylinder 24 through the return line 58.

Referring to FIGS. 1 and 2, in operation, hydraulic fluid is supplied to the mast assembly 14 to raise the carriage 16. Due to the intrinsically lower pressure requirement of the larger free lift hydraulic cylinder assembly 23, the free lift ram 26 begins to extend prior to the inner telescopic rams 34. When the free lift ram 26 approaches the fully extended position, the signaling device 56 signals the hydraulic system control to shift the valve 50 from the open flow position 52 to the restricted flow position 54. Restricting the flow of hydraulic fluid to the free lift cylinder 24 increases the fluid pressure in the first stage hydraulic fluid branch line 46, and diverts hydraulic fluid toward the inner telescopic cylinders 28 to initiate the extension of the inner telescopic rams 34 prior to the free lift ram 26 reaching the extended position.

As the inner telescopic rams 34 begins to move upwardly, the reduction in hydraulic fluid flowing into the free lift cylinder 24 causes the free lift ram 26 to decelerate. As the free lift ram 26 approaches the extended position, pressure in the first stage hydraulic branch line 46 continually increases to continually increase the volume of hydraulic fluid flowing through the second stage hydraulic branch line 48. The pressure in the first stage hydraulic branch line 46 continues to increase until the free lift ram 26 reaches the extended position and all of the fluid from the supply line 44 flows into the inner telescopic cylinders 28.

Advantageously, as disclosed above, a constant carriage speed during mast staging can be maintained by using cylinders 24, 28 with properly sized bores and increasingly diverting hydraulic fluid from the free lift cylinder 24 to the inner telescopic cylinders 28 to accelerate the inner telescopic rams 34 at a rate substantially equal to the rate of deceleration of the free lift ram 26. The self-regulating hydraulic circuit 40 modulates flow and pressure between two stages to provide a controlled deceleration of the first stage and a controlled acceleration of the second stage, and provides a smooth momentum transition between stages without changing the speed of the carriage 16.

Rapid descent of the carriage 16 is accomplished by discontinuing the flow of hydraulic fluid through the supply line 44 to the cylinders 24, 28, and allowing unrestricted flow of hydraulic fluid out of the cylinders 24, 28 through the hydraulic lines 44, 48, 58 toward the reservoir 42. Hydraulic fluid flows out of the free lift hydraulic cylinder 24 and back into the supply line 44 though the return line 58. In addition, the valve 50 can be shifted to the open flow position 52 which allows the hydraulic fluid to return to the supply line 44 through the first stage hydraulic branch line 46.

The embodiment disclosed above does not require extensive modification of an existing mast assembly to implement. Advantageously, the present invention can be incorporated into an existing lift truck by modifying the hydraulic circuit supplying hydraulic fluid to the mast stages, and may only require the addition of a two position valve as disclosed above, thus simplifying retrofitting existing equipment.

While there has been shown and described what are at present considered the preferred embodiments of the invention, it will be obvious to those skilled in the art that various changes and modifications can be made therein without departing from the scope of the invention defined by the appended claims. For example, a multi position valve having two or more positions can be used, and the invention can be incorporated into a mast assembly having more than two stages.

I claim:

1. A multistage mast assembly for use on a lift truck, said mast assembly comprising:

a first mast section slidably fixable relative to the truck, and extendible between a retracted position and an extended position;

at least one first hydraulic actuator having an extendible ram fixed to said first mast section, wherein actuation of said first hydraulic actuator extends said ram to slidably move said first mast section between said retracted position and said extended position;

a second mast section slidably fixed relative to said first mast section, and extendible between a retracted position and an extended position;

at least one second hydraulic actuator fixed relative to said first mast section, and having an extendible ram fixed relative to said second mast section, wherein actuation of said at least one second hydraulic actuator extends said at least one second hydraulic actuator ram to slidably move said second mast section relative to said first mast section;

a hydraulic supply line;

a first hydraulic line supplying hydraulic fluid from said hydraulic supply line to said at least one second hydraulic actuator;

a second hydraulic line in parallel with said first hydraulic line, and supplying hydraulic fluid from said hydraulic supply line to said at least one first hydraulic actuator; and a multi-position valve controlling hydraulic fluid flowing through said first hydraulic line, and having an open position and a restricted flow position, wherein hydraulic fluid flows from said supply line through said first hydraulic line to said at least one second hydraulic actuator to slidably move said second mast section relative to said first mast section when said valve is in the open position, and hydraulic fluid pressure in said first hydraulic line increases to divert hydraulic fluid from said hydraulic supply line into said second hydraulic line to actuate said at least one first hydraulic actuator and begin slidably moving said first mast section toward said first mast section extended position prior to said second mast section reaching said second mast section extended position when said valve is shifted to said restricted flow position before said second mast section reaches said second mast section extended position.

2. The mast assembly as in claim 1, wherein when said valve is in the restricted flow position, said first mast section begins extending toward said first mast section extended position prior to said second mast section reaching said second mast section extended position without changing the speed of said second mast section.

3. The mast assembly as in claim 1, in which said second mast section includes a carriage.

4. The mast assembly as in claim 1, in which said at least one second hydraulic actuator has a lower hydraulic fluid pressure requirement to slidably move said second mast section than the hydraulic fluid pressure requirement of said at least one first hydraulic actuator to slidably move said first mast section.

5. The mast assembly as in claim 1, in which a return hydraulic line returns hydraulic fluid supplied by said hydraulic supply line back to said hydraulic supply line, and a check valve disposed in said return hydraulic line prevents hydraulic fluid from bypassing said valve.

6. The mast assembly as in claim 1, in which a signaling device fixed relative to said first mast section extended position provides a signal for moving said valve from said open position to said restricted flow position.

7. The mast assembly as in claim 1, in which said actuators have bores which are sized such that when said hydraulic fluid is restricted in said first hydraulic line, said second mast section decelerates at a rate substantially equal to a rate of acceleration of said first mast section to maintain a substantially constant vertical speed of said second mast section during the transition between said first and second mast sections.

8. A method of staging mast sections of a multistage mast assembly having a first mast section hydraulically extendible from a retracted position to an extended position and a second mast section slidably fixed relative to said first mast section and hydraulically extendible from a retracted position to an extended position, said method comprising:

supplying hydraulic fluid from a hydraulic supply line through a first hydraulic line to the hydraulically extendible second mast section to begin extending the second mast section from the retracted position to the extended position;

restricting the flow of said hydraulic fluid through said first hydraulic line before the second mast section reaches the extended position to increase pressure in said first hydraulic line, and divert hydraulic fluid into a second hydraulic line supplying hydraulic fluid to said hydraulically extendible first mast section to begin extending said first mast section before said second mast section reaches the second mast section extended position.

9. The method as in claim 8, in which the second mast section has a lower hydraulic fluid pressure requirement to extend said second mast section than the hydraulic fluid pressure requirement of said first mast section to extend said first mast section.

10. The method as in claim 8, in which said second mast section includes a carriage which moves vertically when extending at least one of said first mast section and said second mast section, and said method includes maintaining a constant vertical speed of said carriage when restricting the flow of said hydraulic fluid through said first hydraulic line.

* * * * *